US005306019A

United States Patent [19]

Guest et al.

[11] Patent Number: 5,306,019

[45] Date of Patent: Apr. 26, 1994

[54] ARROW WITH NOCK ASSEMBLY

[76] Inventors: Elmer F. Guest, 29 Hancock St.; Leon A. Eckert, 30 Plain St., both of Fitchburg, Mass. 01420

[21] Appl. No.: 971,292

[22] Filed: Nov. 4, 1992

[51] Int. Cl.[5] ..... F42B 6/06

[52] U.S. Cl. ..... 273/416; 403/349

[58] Field of Search ..... 273/416, 419, 420, 421, 273/422, 423; 403/348, 349

[56] References Cited

U.S. PATENT DOCUMENTS

| | | | |
|---|---|---|---|
| 135,655 | 2/1873 | Miller et al. | 403/349 X |
| 795,810 | 8/1905 | Bowe | 403/348 X |
| 1,194,793 | 8/1916 | Styers | 403/349 X |
| 1,696,462 | 12/1928 | Victor | 403/349 X |
| 2,484,589 | 10/1949 | Richards | 273/416 |
| 2,664,078 | 12/1953 | Irwin | 273/416 X |
| 4,856,792 | 8/1989 | Hardison | 273/416 |
| 5,094,464 | 3/1992 | Musacchia, Sr. | 273/419 |
| 5,154,432 | 10/1992 | Saunders | 273/416 |

FOREIGN PATENT DOCUMENTS

| | | | |
|---|---|---|---|
| 2400522 | 9/1974 | Fed. Rep. of Germany | 403/349 |

OTHER PUBLICATIONS

Archer's Bible 1966–67 Mar. 1967 p. 61 Bow Fishing Arrows.

*Primary Examiner*—Paul E. Shapiro

*Attorney, Agent, or Firm*—Blodgett & Blodgett

[57] ABSTRACT

An arrow with a nock assembly is disclosed. The rear end of the arrow shaft has a bore which has a rearwardly facing opening. One or more vanes are fixed to the outer surface of the arrow shaft. An adapter is mounted within the bore and is fixed to the shaft in a predetermined angular position about the central longitudinal axis of the arrow shaft relative to the vanes. The adapter has a socket which has a rearwardly facing opening. A nock which has a head end, and a bifurcated tail end, is removably mounted to said adapter so that the head end is located within the socket and the bifurcated tail end is outside of the socket. A mechanism is also provided for releasably locking the head end of the nock within the socket so that the nock is in a fixed angular position about the shaft axis relative to the adapter and the vanes and in a fixed position lengthwise of the shaft axis relative to the adapter socket opening.

9 Claims, 3 Drawing Sheets

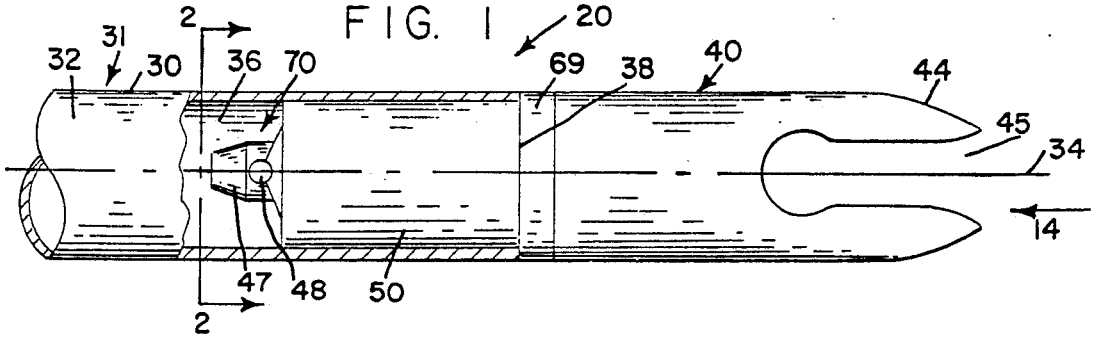
FIG. 1
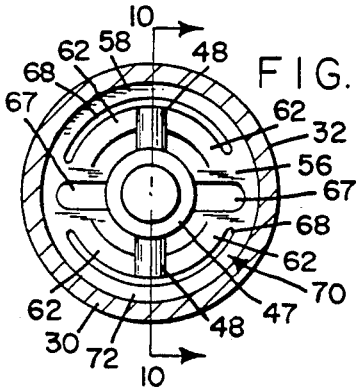
FIG. 2
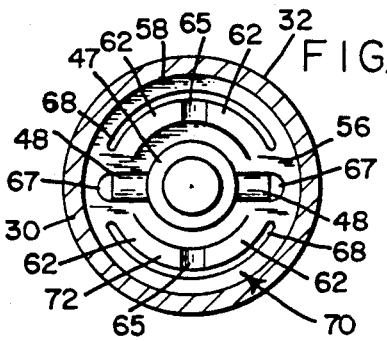
FIG. 3
FIG. 5
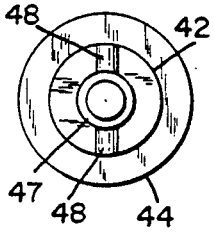
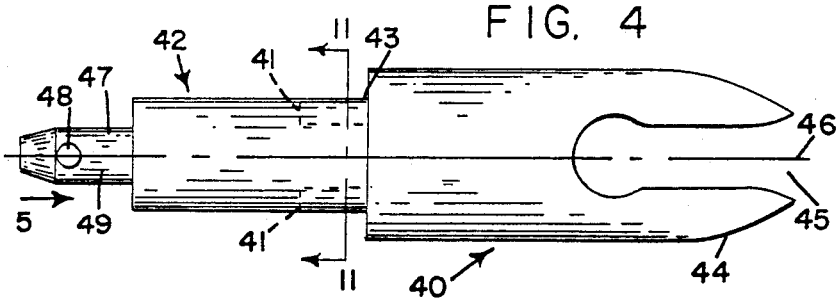
FIG. 4
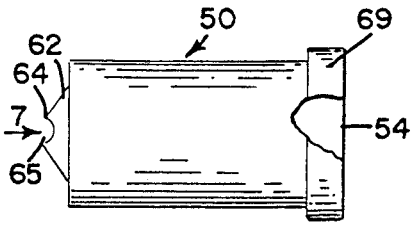
FIG. 6
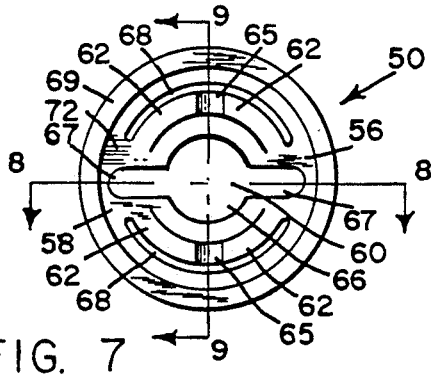
FIG. 7

FIG. 14
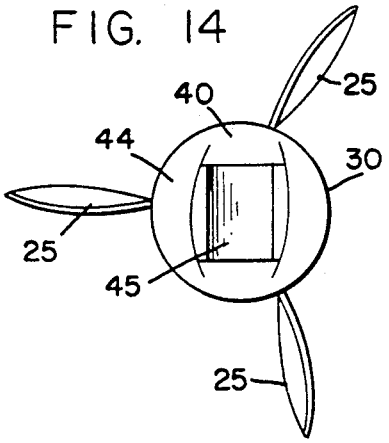
FIG. 18
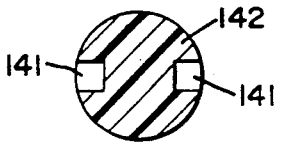
FIG. 15
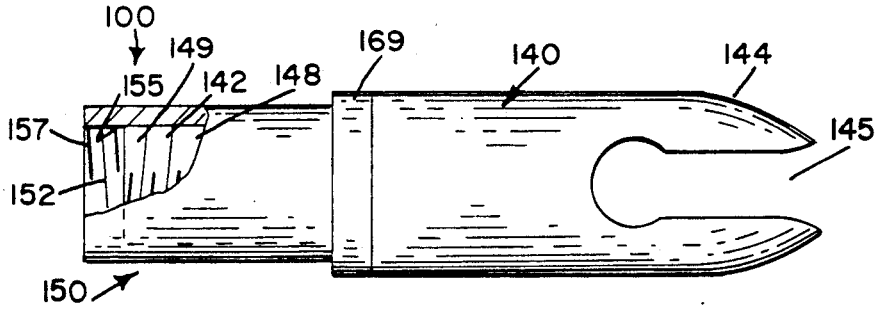
FIG. 17
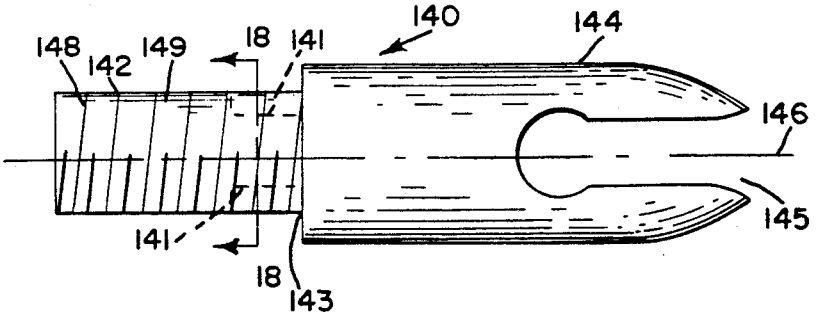
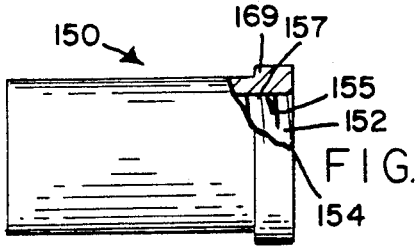
FIG. 16

ARROW WITH NOCK ASSEMBLY

BACKGROUND OF THE INVENTION

The field of invention relates generally to arrows with nock assemblies, and more particularly, pertains to arrows with replaceable nocks.

The nock is the rearmost assembly of an arrow that bears a notch for engaging the bowstring. The bowstring is engaged by the notch during the drawing back of the bowstring and during the release of the bowstring.

Of critical importance is the proper alignment of the nock about the shaft axis of the arrow relative to the vanes. When the nock is properly aligned, and the arrow is positioned on the bow, one feather or vane is essentially above the notch, a second feather or vane is essentially below the notch, and the third feather or vane extends away from the bow. This positioning creates a minimum of interference between the feathers or vanes and the bow during the positioning and release of the arrow.

A well known problem in archery, especially during target practice, is the so called "Robin Hood" shot. In the Robin Hood shot, a second arrow, fired at a target, strikes the rearmost portion of a first arrow which is already imbedded in the target. The impact typically results in the destruction of the nock of the first arrow. In the context of a competition, or in the field, while hunting, replacement of a fixedly attached nock is not practical.

Replaceable, or removable arrow nocks are known. This allows for continued use of the same arrow. The replaceable nock has a base with a forwardly facing, conically shaped cavity. The cavity is designed to receive the rear tip of the arrow shaft which is also conically shaped. Within the cavity of the nock are inwardly projecting circular or spiral retaining ribs. These ribs contact and locally deform the rear tip of the arrow shaft, to secure the nock to the shaft. The ribs enable a damaged nock to be replaced without the need for glue.

Use of this particular nock is restricted to a solid shaft arrow. Further, the application of the nock to the end of the arrow causes a deformation of the end of the arrow shaft with the resultant damaging effect.

Another known removable nock has a mounting portion with an outer circumference which conforms to the inner diameter of the shaft of the arrow. The mounting portion is slidably, removably received within the shaft of the arrow.

None of the known prior art nocks deal with the problem of alignment of the nock with the vanes or feathers of the arrow. Further, none of the prior art nocks have a positive locking feature. Without such a feature, the nock has a tendency to become loose or dislodged through wear or normal use.

These and other difficulties experienced with the prior art nocks have been obviated in a novel manner by the present invention.

It is, therefore, a principal object of the invention to provide an arrow with a nock assembly having a nock that is replaceable, but positively locked when attached to the arrow, to avoid loss of the nock.

Another object of this invention is the provision of an arrow with a nock assembly having means to assist with alignment of the nock with the vanes or feathers of the arrow.

It is another object of the instant invention to provide an arrow with a nock assembly having a replaceable nock that does not damage the shaft of the arrow.

A still further object of the invention is the provision of an arrow with a nock assembly that allows for replacement of the nock when the nock becomes damaged.

It is a further object of the present invention to provide an arrow with a nock assembly that is simple in construction, which is inexpensive to manufacture, and which is capable of a long life of useful service with a minimum of maintenance.

A further object of the invention is the provision of an arrow with a nock assembly in which the nock can be easily and quickly replaced.

With these and other objects in view, as will be apparent to those skilled in the art, the invention resides in the combination of parts set forth in the specification and covered by the claims appended hereto.

SUMMARY OF THE INVENTION

An arrow with a nock assembly in which the nock is replaceable in the event of damage to the nock or the desire for using a nock of a different style. The invention further permits the proper alignment of the nock with the vanes or feathers, and the ability to positively lock the nock to the shaft of the arrow. The arrow has a shaft with an outer cylindrical surface, a central longitudinal shaft axis, a bore which extends along the axis, and a first rear opening to the bore. At least one vane is fixed to the outer cylindrical surface of the shaft. An adapter is mounted within the bore at the first rear opening, and longitudinally parallel to the shaft axis. The adapter is fixed to the shaft in a predetermined angular position about the shaft axis relative to the vanes. The adapter has a socket and a second rear opening to the socket. The arrow further has a nock with a head end, a bifurcated tail end, and a central longitudinal nock axis, collinear with the shaft axis. The nock is removably mounted to the adapter so that the head end is located within the socket and the bifurcated tail end is outside of the socket. A mechanism is also provided for releasably locking the head end of the nock within the socket so that the nock is in a fixed angular position about the shaft axis relative to the adapter and the vanes and in a fixed position lengthwise of the shaft axis relative to the second rear opening.

In the preferred embodiment, the nock assembly comprises at least one locking pin that radially extends from the head end of the nock and a wall contained within the socket of the adapter, and perpendicular to a longitudinal axis of the shaft. The wall has an aperture and a forward surface which faces away from the second rear opening. The head end of the nock has a reduced forward portion which contains the pin and which extends through the aperture so that the pin is adjacent to the forward surface. The reduced forward portion and the pin are removable rearwardly through the aperture. The forward surface of the wall has a cam surface which tapers gradually forward from the forward surface to a forwardmost point. A depression is located at the forwardmost point of the cam surface for releasably retaining the locking pin in a fixed position relative to the wall. The wall can be resiliently deformable so that the pin is biased forwardly by the wall when the pin is in the depression.

In an alternative embodiment of the invention, the mechanism for releasably locking the head end of the nock within the socket is comprised of threading on the outside circumferential surface of the head end of the nock and complementary threading on the inside circumferential surface of the socket.

BRIEF DESCRIPTION OF THE DRAWINGS

The character of the invention, however, may be best understood by reference to one of its structural forms, as illustrated by the accompanying drawings, in which:

FIG. 1 is a top plan view of a portion of an arrow, embodying the principals of the present invention, with part of the shaft broken away and sectioned to show the adapter and a portion of the nock, FIG. 2 is a vertical cross sectional view, in enlarged scale, of the arrow of FIG. 1, taken along the line 2—2 thereof, looking in the direction of the arrows, and showing the position of the locking pins when the nock is in a locking angular position, FIG. 3 is a similar view to that of FIG. 2, showing the position of the locking pins when the nock is in a non-locking angular position, FIG. 4 is a top plan view of a nock, embodying the principals of the present invention, FIG. 5 is an end view of the nock of FIG. 4, looking in the direction of the arrow 5, FIG. 6 is a top plan view of an adapter, embodying the principals of the present invention, FIG. 7 is an end view, in enlarged scale, of the adapter of FIG. 6, looking in the direction of the arrow 7, FIG. 14 is an end view of the arrow of FIG. 1, looking in the direction of arrow 14, with vanes added, FIG. 15 is a top plan view of a second embodiment of a nock assembly, embodying the principals of the present invention, FIG. 16 is a top plan view, depicting the adapter portion of the second embodiment, FIG. 17 is a top plan view of the nock portion of the second embodiment, and FIG. 18 is a vertical cross-sectional view of the nock of FIG. 17, taken along the lines 18—18, thereof, and looking in the direction of the arrows.

DESCRIPTION OF THE PREFERRED EMBODIMENT

Figure 8:
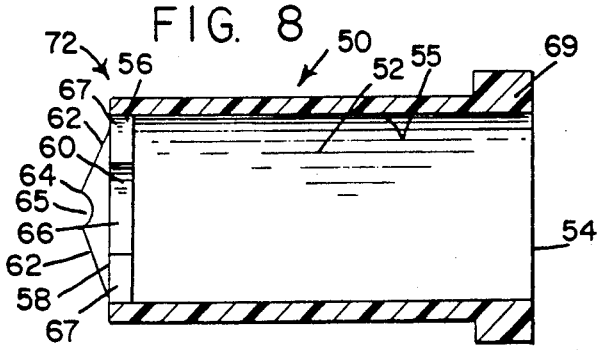
FIG. 8 is a horizontal cross sectional view of the adapter of FIG. 7, taken along the line 8—8 thereof, and looking in the direction of the arrows.

With reference now to the drawings, there is shown in FIG. 1, a nock assembly, embodying the principles of the present invention, and generally indicated by the reference numeral 20. The nock assembly 20 is shown in FIG. 1 mounted in the rear portion of an arrow which is generally indicated by the reference numeral 31.

The arrow 31 has a shaft 30 with an outer cylindrical surface 32 and a central longitudinal shaft axis 34. The shaft 30 also has a bore 36 which extends along the central longitudinal shaft axis 34. The bore 36 has a first rear opening 38. The nock assembly 20 consists of an adapter 50 and a nock 40 which is removably mounted to the adapter 50. The adapter 50 is positioned within the bore 36, at the first rear opening 38. The adapter 50 is positioned longitudinally parallel to the shaft axis 34, and is fixed to the shaft 30 in a predetermined angular position about the shaft axis 34 relative to the arrow feathers or vanes 25, which vanes are shown in FIG. 14. The vanes 25 are fixed to the outer cylindrical surface 32 of the shaft 30.

Figure 11:
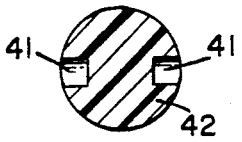
FIG. 11 is a vertical cross-section of the nock shown in FIG. 4, taken along the line 11—11, thereof, and looking in the direction of the arrows.
Figure 9:
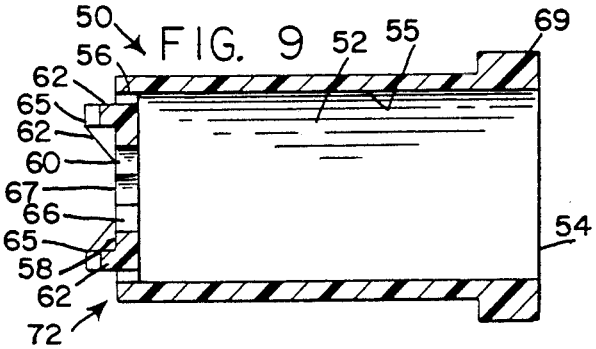
FIG. 9 is a vertical cross sectional view of the adapter of FIG. 7, taken along the line 9—9 thereof, and looking in the direction of the arrows.

Referring to FIGS. 4, 5, and 11, the nock 40 is comprised of a head end 42 and a bifurcated tail end 44, which bifurcated tail end 44 defines a notch 45 for engaging a bow string (not indicated). Each of a pair of grooves 41, begins at a junction 43 of the head end 42 and the bifurcated tail end 44, and extends longitudinally along at least a part of the head end 42. The head end 42 has a reduced forward portion 47, which carries a pair of locking pins 48 on an outer cylindrical surface 49 of the head end 42. The locking pins 48 extend radially outward from the head end 42 of the nock 40. The nock 40 has a central longitudinal nock axis 46.

Referring next to FIGS. 6 through 9, the adapter 50 has a socket 52 with a second rear opening 54 and an inner cylindrical surface 55. A wall 56 is located within the socket 52 of the adapter 50, and is positioned at the forward end of the socket 52. The wall 56 is further positioned perpendicularly to the shaft axis 34 when the adapter 50 is positioned longitudinally parallel to the shaft axis 34. A forward surface 58 of the wall 56 faces away from the second rear opening 54.

The wall 56 of the adapter 50 also contains an aperture 60 which consists of a central circular portion 66 and a pair of radially extending slots 67. The central circular portion 66 is concentric to the shaft axis 34 when the adapter 50 is positioned longitudinally parallel to the shaft axis 34. The radially extending slots 67 are contiguous with the central circular portion 66. The wall 56 has a pair of arcuate slits 68 which render the wall 56 more flexible.

A plurality of cam surfaces 62 are located on the forward surface 58 of the wall 56. Each cam surface 62 tapers gradually forward from the forward surface 58 to a forwardmost point 64 adjacent a depression 65. The depressions 65 as well as the wall 56 with its forward surface 58, the aperture 60 with its central circular portion 66 and radially extending slots 67, the cam surface 62 with its forwardmost point 64 and the arcuate slits 68 in the wall 56 function as detent means 72 for the pins 48 when the nock 40 is combined with the adapter 50 in the locking mode as shown in FIGS. 1 and 2. The pins 48 and the detent means 72 constitute retaining means 70 for maintaining the nock 40 in a locked position in the adapter 50.

The adapter 50 is constructed of a deformable resilient material such as a plastic polymer. The rear end of the adapter 50 is provided with an outwardly extending flange 69, which abuts the rear end of the arrow 31 when the adapter 50 is positioned within the bore 36.

Figure 10:
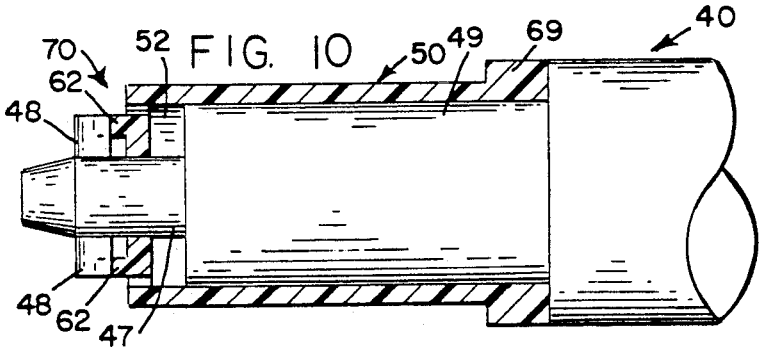
FIG. 10 is a vertical cross sectional view of the adapter shown in FIG. 2, taken along the line 10—10 thereof, and looking in the direction of the arrows. A portion of the nock is also depicted within the sectioned adapter, in the locking position.

To allow for the mounting of the nock 40 to the adapter 50, the diameter of the inner cylindrical surface 55 of the adapter 50 is substantially the same as the outer cylindrical surface 49 of the nock 40, but they are provided with sufficient clearance to enable the head end 42 of the nock 40 to move within the socket 52 of the adapter 50. Reference should be had to FIG. 10. The locking pin 48 is also spaced from the inner cylindrical surface 55 of the adapter 50 when the reduced forward portion 47 of the nock 40 is within the socket 52 of the adapter 50. See FIG. 10.

As the nock 40 is mounted to the adapter 50, in the non-locking angular position, the reduced forward portion 47 of the nock extends into the central circular portion 66 of the aperture 60 in the wall 56 of the adapter 50. At the same time, the locking pins 48 of the nock 40 extends through the radially extending slots 67 of the aperture 60 in the wall 56 of the adapter 50. The aperture 60 is shaped so that the reduced forward portion 47 and the locking pins 48 can pass freely through the aperture 60 when the nock 40 is in the non-locking angular position relative to the shaft axis 34. See FIG. 3. The reduced forward portion 47 and the locking pin 48 are also removable rearwardly through the aperture 60.

In the non-locking angular position, the locking pins 48 are adjacent to the forward surface 58 of the wall 56 and the locking pin 48 is rearward of the depression 65 on the cam surface 62. The detent means 72 releasably retains the locking pin 48 when the nock is in a fixed angular position. See FIGS. 1, 2 and 10. Specifically, when the nock 40 is rotated about the shaft axis 34 from the non-locking angular position to the locking angular position, the locking pin 48 slides along the cam surface 62 from the forward surface 58 of the wall 56 to the depression 65 of the cam surface 62. The depression 65 receives the locking pin 48 and releasably retains it in a fixed position relative to the wall 56. The locking pin 48 is therefore forward of and aligned with a solid portion of the forward surface 58 of the wall 56 when the nock 40 is in a fixed angular position. In such fixed angular position, the locking pin 48 is out of alignment with the radially extending slot 67.

The invention having been thus described, the operation will now be clear to those of ordinary skill in the art as described below.

The adapter 50 is mounted within the bore 36 of the arrow shaft 30 at the first rear opening 38, and is positioned longitudinally parallel to the shaft axis 34. The nock 40 is removably mounted to the adapter 50 so that the head end 42 of the nock 40 is located within the socket 52 of the adapter 50, and the bifurcated tail end 44 of the nock 40 is located outside of the socket 52. With the nock 40 mounted to the adapter 50 in the locked position, the adapter 50 is fixed to the shaft 30, typically with an appropriate glue, so that the adapter 50 is in a predetermined angular position about the shaft axis 34, relative to the vane 25. The angular position is selected so that when a bowstring (not indicated) is in the notch 45 of the mounted nock 40, one vane 25 will be essentially above the notch 45, a second vane 25 will be essentially below the notch 45, and a third vane 25 will extend away from the bow (not indicated). Reference should be had to FIG. 14 for the relative positioning.

When the nock 40 is mounted in its locked position within the socket 52 of the adapter 50, the nock 40 is in a fixed angular position about the shaft axis 34 relative to the adapter 50 and the vane 25 and is in a fixed position lengthwise of the shaft axis 34 relative to the second rear opening 54 of the adapter 50. When the nock 40 is mounted to the adapter 50, the central longitudinal nock axis 46 is collinear with the shaft axis 34.

Figure 12:
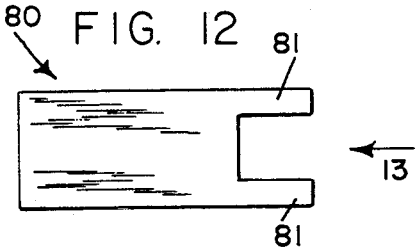
FIG. 12 is a top plan view of a dislodging tool.
Figure 13:
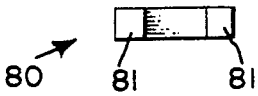
FIG. 13 is an end view of the dislodging tool of FIG. 12, looking in the direction of arrow 13.

In the event of the previously discussed "Robin Hood" shot or other damage to the nock 40, a common location of breakage is the line 11—11 as shown in FIG. 4. In the event of such breakage, the ends of the grooves 41 will be accessible to the archer as shown in FIG. 11. The archer may then use the dislodging tabs 81 of a dislodging tool 80, as shown in FIGS. 12 and 13, in the ends of the grooves 41 to remove the remains of nock 40 from the adapter 50, prior to installing a new nock 40. The tool 80 is used by inserting the tabs 81 into the grooves 41 and rotating the tool 80 about the central longitudinal nock axis 46. This effectively rotates the nock 40 to a non-locking angular position so that the broken forward portion of the nock 40 can be easily removed from the adapter 50.

Referring to FIGS. 15-18, there is shown a modified nock assembly generally indicated by the reference numeral 100. Nock assembly 100 comprises a nock 140, and an adapter 150.

Referring to FIG. 17, the nock 140 comprises a head end 142 and a bifurcated tail end 144, which bifurcated tail end 144 defines a notch 145 for engaging a bow string (not indicated). A groove 141, begins at the junction 143 of the head end 142 and the bifurcated tail end 144, and extends longitudinally along at least a part of the head end 142. The head end 142 has an outer cylindrical surface 149 with threading 148. The nock 140 has a central longitudinal nock axis 146.

Referring next to FIG. 16, the adapter 150 has a socket 152 with a second rear opening 154 and an inner cylindrical surface 155 with threading 157 which is complementary to the threading 148 on the outer cylindrical surface 149 of the head end 142 of the nock 140. The adapter 150 is positioned longitudinally parallel to the shaft axis 34.

The rear end of the adapter 150 has a circular flange 169, which extends outwardly from the outer surface of the adapter 150. The flange 169 abuts the rear end of the arrow when the adapter 150 is inserted within the bore 36 of the arrow.

The adapter 150 is mounted within the bore 36 of the shaft 30 at the first rear opening 38, and is positioned longitudinally parallel to the shaft axis 34. The nock 140 is removable mounted to the adapter 150 so that the head end 142 of the nock 140 is located within the socket 152 of the adapter 150, and the bifurcated tail end 144 of the nock 140 is located outside of the socket 152. With the nock 140 mounted to the adapter 150, the adapter 150 is fixed to the shaft 30, typically with an appropriate glue, so that the adapter 150 is in a predetermined angular position about the shaft axis 34, relative to the vane 25. The angular position is selected so that when a bowstring (not indicated) is in the notch 145 of the mounted nock 140, one vane 25 will be essentially above the notch 145, a second vane 25 will be essentially below the notch 145, and a third vane 25 will extend away from the bow (not indicated). The positioning of the alternative embodiment of the adapter 150 and nock 140 relative to the vanes 25 of the arrow 31 is identical to the positioning of the preferred embodiment of the adapter 50 and nock 40 as is shown in FIG. 14.

When the nock 140 is fully threaded into the adapter 150, the nock 140 is in a fixed angular position about the shaft axis 34 relative to the adapter 150 and the vane 25 and is in a fixed position lengthwise of the shaft axis 34 relative to the second opening 154 of the adapter 150. When the nock 140 is mounted to the adapter 150, the central longitudinal nock axis 146 is collinear with the shaft axis 34.

As the nock 140 is mounted to the adapter 150, the threading 148 on the outer cylindrical surface 149 of the nock 140 is engaged by the complementary threading 157 on the inner cylindrical surface 155 of the adapter 150. Reference should be had to FIG. 15.

In the event of the previously discussed "Robin Hood" shot or other damage to the nock 140, a common location of breakage is the line 18—18 as shown in FIG. 17. In the event of such breakage, the ends of the grooves 141 will be accessible to the archer as shown in FIG. 18. The archer may then use the dislodging tabs 81 of the dislodging tool 80, as shown in FIGS. 12 and 13 in the ends of the grooves 141 to remove the remains of nock 140 from the adapter 150, prior to installing a new nock 140.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A nock assembly, for an arrow, the arrow having a shaft and at least one vane, the shaft having an outer cylindrical surface, a central longitudinal shaft axis, a bore which extends along said axis, and a first rear opening to the bore, the vane being fixed to the outer cylindrical surface, which nock assembly comprises:

(a) an adapter which is mounted within the bore at the first rear opening and is longitudinally parallel to the shaft axis, said adapter being fixed to the shaft in a predetermined angular position about the shaft axis relative to the vane, said adapter having a socket which has an inner cylindrical surface and a second rear opening to the socket;

(b) a nock having a head end, a bifurcated tail end, and a central longitudinal nock axis which is collinear with said shaft axis, said nock being removably mounted to said adapter so that said head end is located within said socket, said head end having an outer cylindrical surface and a reduced forward portion and said bifurcated tail end is located outside of said socket; and (c) retaining means for releasably locking the head end of said nock within the socket so that the nock is in a predetermined locking angular position lengthwise of the shaft axis relative to the second opening, said retaining means comprising:

(1) at least one locking pin which extends radially outward from the reduced portion of said head end of the nock, said pin being spaced from said inner cylindrical surface when said reduced portion is within said socket; and (2) a detent means on said adapter for releasably retaining the locking pin when said nock is in said predetermined locking angular position, said detent means comprising a wall at the forward end of said socket which is perpendicular to the shaft axis, said wall having an aperture and a forward surface, said aperture being shaped so that said reduced portion and said pin can pass freely through said aperture when said nock is in a non-locking angular position relative to said shaft axis and so that said pin is forward of and aligned with a solid portion of said forward surface when said nock is in said predetermined angular locking position.

2. The nock assembly of claim 1, wherein said detent means further comprises a cam surface which tapers gradually forward from said forward surface to a forwardmost point, said forwardmost point having a depression for receiving said pin so that when said nock is rotated bout said shaft axis from said non-locking angular position to said locking angular position, said pin slides along said cam surface from said forward surface to said depression.

3. The nock assembly of claim 2, wherein said pin is rearward of said depression when said nock is in said non-locking angular position and said wall is resiliently deformable so that said pin is biased forwardly by said wall when said pin is in said depression.

4. The nock assembly of claim 3, wherein the wall has at least one slit to impart resiliency to at least a part of the wall.

5. The nock assembly of claim 4, wherein the slit is arcuate.

6. The nock assembly of claim 5, wherein the adapter is made of a resilient material.

7. The nock assembly of claim 6, wherein the resilient material is a plastic polymer.

8. The nock assembly of claim 1, wherein said aperture has a central circular portion which is concentric to the shaft axis, and at least one radially extending slot which is contiguous with the central circular portion, and wherein the diameters of said inner and outer surfaces are substantially the same with sufficient clearance to enable said head end to move within said socket, said reduced portion extending into said central circular portion, and said locking pin extending through said radially extending slot when said nock is in said non-locking angular position.

9. A nock assembly, for an arrow, the arrow having a shaft and at least one vane, the shaft having an outer cylindrical surface, a central longitudinal shaft axis, a bore which extends along said axis, and a first rear opening to the bore, the vane being fixed to the outer cylindrical surface, which nock assembly comprises:

(a) an adapter which is mounted within the bore at the first rear opening and is longitudinally parallel to the shaft axis, said adapter being fixed to the shaft in a predetermined angular position about the shaft axis relative to the vane, said adapter having a socket and a second rear opening to the socket;

(b) a nock having a head end, a bifurcated tail end, and a central longitudinal nock axis which is collinear with said shaft axis, said nock being removably mounted to said adapter so that said head end is located within said socket and said bifurcated tail end is located outside of said socket, said head end having at least one longitudinal groove, which groove beings at the junction of the head end and the tail end and extends along at least a part of the head end, which groove further permits removal of a broken portion of the nock from the adapter, and (c) retaining means for releasably locking the head end of said nock within the socket so that the nock is in a predetermined locking angular position about the shaft axis relative to the adapter and the vane and is in a predetermined position lengthwise of the shaft axis relative to the second opening.

* * * * *